United States Patent [19]

Hutchison

[11] 4,382,714

[45] May 10, 1983

[54] VEHICLE DISABLING MEANS

[76] Inventor: Walter G. Hutchison, 185 Bear Creek Rd., Asheville, N.C. 28806

[21] Appl. No.: 241,403

[22] Filed: Mar. 6, 1981

[51] Int. Cl.[3] ..... E01F 13/00

[52] U.S. Cl. ..... 404/6; 404/9

[58] Field of Search ..... 404/6, 9, 11, 12; 256/14, 18, 15

[56] References Cited

U.S. PATENT DOCUMENTS

| | | | |
|---|---|---|---|
| 29,978 | 9/1860 | Lee | 256/14 |
| 629,305 | 7/1899 | Ross | 256/14 |
| 658,352 | 9/1900 | Donovan | 256/14 |
| 1,252,153 | 1/1918 | Nelson | 256/14 |
| 1,338,006 | 4/1920 | Fink | 256/18 |
| 1,527,107 | 2/1925 | Allen | 404/6 |
| 4,101,235 | 7/1978 | Nelson | 404/6 |

FOREIGN PATENT DOCUMENTS

| | | | |
|---|---|---|---|
| 2843426 | 4/1980 | Fed. Rep. of Germany | 404/6 |
| 3070 | 7/1919 | Netherlands | 256/14 |

*Primary Examiner*—Nile C. Byers, Jr.

*Attorney, Agent, or Firm*—Mills & Coats

[57] ABSTRACT

This invention is a vehicle disabling means in the form of a plurality of spike-like devices adapted to project perpendicular to a road surface to puncture one or more tires of a fleeing vehicle. A plurality of the devices are preferably interconnected for ease of putting in place and removing as well as creating a flailing effect when engaged.

7 Claims, 4 Drawing Figures

VEHICLE DISABLING MEANS

FIELD OF INVENTION

This invention relates to law enforcement equipment and more particularly to means for at least partially disabling the fleeing vehicles of fugitives.

BACKGROUND OF INVENTION

Since the advent of motor vehicles, law enforcement personnel have been faced with the problem of how to stop the fleeing vehicle of fugitives. Portable barricades have been erected for this purpose but the vehicles more often than not simply plow through the same and keep going. Additionally, two or more police vehicles are parked across the road to form a roadblock in hopes of stopping the fleeing vehicle. Quite often serious wrecks occur as a result of this type of roadblock with both the fugitive or fugitives and the law enforcement personnel on the scene being injured. Additionally, the cost to the public as a result of attempts to crash through vehicle roadblocks can be extremely high in damaged or destroyed vehicles.

Further, over and above the cost of barricades and vehicles, a large number of law enforcement personnel are required to properly set up a roadblock and maintain the same.

BRIEF DESCRIPTION OF INVENTION

After much research and study into the above-mentioned problems, the present invention has been developed to provide an effective means for slowing a fleeing vehicle without endangering law enforcement personnel or equipment. Also this can be accomplished very quickly by one person thus allowing greater dispersion of personnel.

In essence, the vehicle disabling means of the present invention is a hollow, spike-like device having a base thereon for maintaining an upright disposition. A plurality of barbs are provided and the units are interconnected either by a breakaway strand or by flailing chains. Because the barb portion is hollow, the tires of the fleeing vehicle can be very rapidly deflated but yet not so rapidly as to cause a blowout.

In view of the above, it is an object of the present invention to provide a means for disabling a fleeing vehicle.

Another object of the present invention is to provide a means which can be set up by one person for creating an effective roadblock against fleeing vehicles.

Another object of the present invention is to provide a disabling means for vehicles in the form of an effective tire puncturing means.

Another object of the present invention is to provide a vehicle disabling means including a means for deflating tires and to cause a flailing action within the wheel well of such vehicle.

Another object of the present invention is to provide a readily settable and removable roadblock type vehicle disabling means. Another object of the present invention is to provide a vehicle disabling means in the form of a disk shaped base having a deflating spike fixed thereto and disposed perpendicular therewith.

Another object of the present invention is to provide a vehicle disabling means which includes means for retaining a deflation device in a tire thereof.

Another object of the present invention is to provide a vehicle disabling means in the form of a puncture device having barbs for retaining the same within a tire.

Other objects and advantages of the present invention will become apparent and obvious from a study of the following description and the accompanying drawings which are merely illustrative of such invention.

DETAILED DESCRIPTION OF DRAWINGS

With further reference to the drawings, the vehicle disabling means of the present invention includes a plurality of deflators indicated generally at 10. Each of these deflators includes a base portion 11 and a shaft or spike portion 12 perpendicularly disposed therefrom.

The base portion can be constructed of metal or other suitably strong material and is generally disk shaped in the preferred embodiment although it could, of course, be square, octagonal, or other shape. It has been found that a somewhat dome shaped, disk-like base portion is preferable since this configuration will give a more steady platform for the spike on rough surfaces such as tar and gravel roads than a flat configuration.

Figure 1:
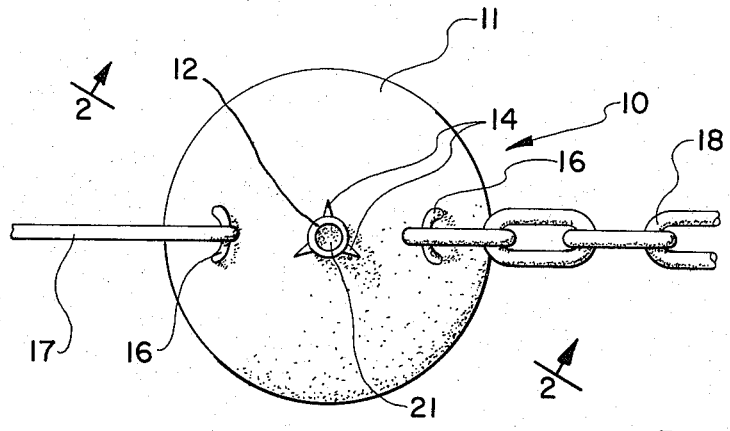
FIG. 1 is a top plan view of one of the individual disabling means showing a flailing chain connected thereto.
Figure 2:
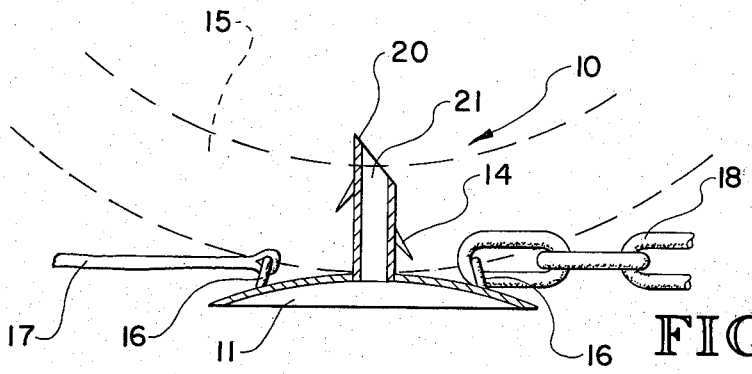
FIG. 2 is a sectional view taken through lines 2—2 of FIG. 1.
Figure 3:
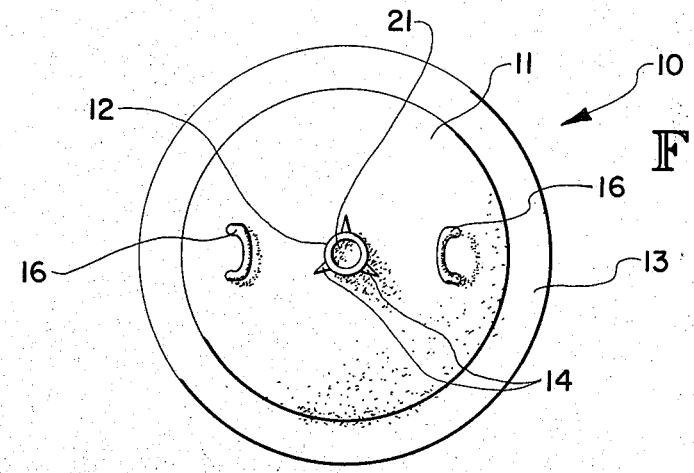
FIG. 3 is a top plan view of a modification of the disabling means.
Figure 4:
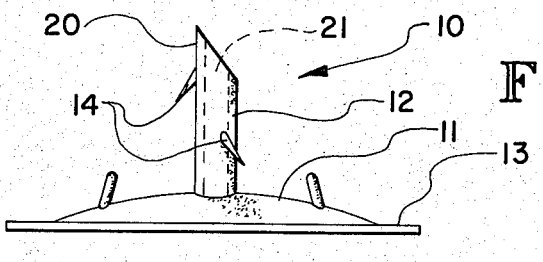
FIG. 4 is a side elevational view of such modification.

The outer edge 13 of base 11 in the modification shown in FIGS. 3 and 4 has somewhat of an advantage over the embodiment shown in FIGS. 1 and 2 in that the edge or flange will tend to give greater stability on soft surfaces such as sand as well as greater initial stability on contact by a tire while at the same time exhibiting the good features mentioned above relative to the domed base generally.

The shaft or spike 12 is fixedly secured to base 11 by a suitable means such as weldment, threading, or the like. Since attachments of this type are well known to those skilled in the art further detailed discussion of the same is not deemed necessary.

A plurality of barb-like projections 14 are randomly provided on the exterior of spike 12 as can clearly be seen in the drawings. These barbs are so sized and spaced as to securely hold the spike in the tire once it has been engaged.

An axial opening 21 is provided through spike or shaft portion 12 and likewise communicates through base portion 11 thus allowing air from the inside of the tire 15 to pass therethrough to deflate such tire.

A bail or other suitable attaching means 16 is provided on base 11 and is adapted to connect to either a strand or cord 17 of such strength to allow breakaway upon engagement of the deflator with the tire or to connect to a short lenght of flailing chain 18. It is also envisioned that a short length of chain could be connected to each of the bases 11 and then a breakaway cord or strand for connecting the end of the chain to the next adjacent deflator.

In any case the cords or strands 17 are used to allow quick placement of the disabling means across the road or other area involved and yet the individual deflators can instantaneously and automatically breakaway from the rest of the system when it penetrates a tire. The remaining deflators can then be quickly removed from the area since they are still connected to each other.

It is also envisioned that the cord or strand 17 could have the deflators breakawayingly attached thereto so that the cord would remain even though the deflator was engaged and taken with the fleeing vehicle. The purpose of the cord system is, of course, to allow the various deflators to be quickly deployed in the road block area and yet just as quickly removed from the same to prevent nonfleeing vehicles from deflatingly engaging the same.

When the vehicle disabling means of the present invention is needed, the user thereof simply grasps one end of the means interconnecting the deflators and pulls the same across the road or other area to be blocked. Because of the flat base portion 11, each of the deflators will sit upright with the hollow spike or shaft portion 12 being disposed perpendicular to the road surface. Although not specifically shown, it is also envisioned that the interconnecting cords could be attached to the upper portion of each of the spikes 12 so that as the vehicle disabling means of the present invention is lowered to the ground, all the spikes will be pointing upward.

In any case the deflators themselves are so disposed that at least one of the deflators will be within the path of travel of the fleeing vehicle. As the beveled or pointed tip 20 of the spike portion 12 comes in contact with the tire, the weight of the vehicle will drive such spike through the tread so that the slope portion is actually within the interior of the tire. Since the axial opening 21 extends through both the spike portion 12 and the base portion 11, the air within the tire will immediately escape therethrough thus causing the tire to go flat.

The deflators of the present invention can be supplied in various sizes with varying degrees of air release capacities depending on the interior cross-section of the individual openings 21. These deflators thus could allow a slow loss of air so that the tire goes flat gradually or could have such an opening as to cause an almost immediate deflation.

If the individual deflators 10 include flailing chains connected thereto, when one or more of the same is engaged with a tire 15, the chains will fly wildly about thus creating a significant and unnerving sound and bumping motion caused by the free end of the chain slamming into the wheel well housing similar to a loose set of snow chains although much louder than the same due to the high speed of a fleeing vehicle versus the usual relative slow speeds involved in winter driving.

Once the fleeing vehicle has passed or when there is no longer a need for the roadblock, the disabling means of the present invention can be simply removed by picking up the ends of the means interconnecting the individual deflator and placing the same in a suitable storage means ready for the next use.

From the above it is obvious that the present invention has the advantage of providing a relatively inexpensive and yet highly efficient means for slowing fleeing vehicles. This means can be readily set up across a road and removed by one person thus freeing the normal plurality of personnel needed to set up a road block type operation. The present invention has the further advantage of not only providing a means for slowing a fleeing vehicle by deflating one or more of its tires but also of unnerving the fugitive by creating a bumping motion due to the presence of the base as well as an extremely loud banging noise caused by the flailing chains connected to the individual deflators.

The present invention may, of course, be carried out in other specific ways than those herein set forth without departing from spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A vehicle disabling means comprising: a plurality of tire deflating means in the form of a relatively flat base with a hollow, spike like member perpendicularly disposed therefrom whereby when said spike like member penetrates the tire of a vehicle, the air within such tire will escape through the hollow in the spike; and means interconnecting said deflating means to allow rapid deployment and retrieval of said disabling means.

2. The vehicle disabling means of claim 1 wherein said hollow, spike-like member has barbs outwardly disposed therefrom whereby once penetration of the tire has been accomplished, the deflating means will be retained therein.

3. The vehicle disabling means of claim 2 wherein said base is dome shaped.

4. The vehicle disabling means of claim 3 wherein said dome shaped base has a relatively flat, flange-like portion disposed about its periphery.

5. The vehicle disabling means of claim 1 wherein said base is dome shaped.

6. The vehicle disabling means of claim 5 wherein said dome shaped base has a relatively flat, flange-like portion disposed about its periphery.

7. A vehicle disabling means comprising; a plurality of tire deflating means; means interconnecting said deflating means to allow rapid deployment and retrieval of said disabling means; and flailing means secured to said deflating means whereby an unnerving sound is created by such means beating against adjacent parts of the vehicle.

* * * * *